US007176630B2

(12) United States Patent
Hendrix et al.

(10) Patent No.: US 7,176,630 B2
(45) Date of Patent: Feb. 13, 2007

(54) HIGH-PRESSURE DISCHARGE LAMP

(75) Inventors: Johan Leopold Victorina Hendrix, Eindhoven (NL); Hubertus Cornelis Maria Van den Nieuwenhuizen, Eindhoven (NL); Petrus Hendrikus Antonis, Eindhoven (NL)

(73) Assignee: Koninklijke Philips Electronics, N.V., Eindhoven (NL)

( * ) Notice: Subject to any disclaimer, the term of this patent is extended or adjusted under 35 U.S.C. 154(b) by 146 days.

(21) Appl. No.: 10/495,955

(22) PCT Filed: Oct. 29, 2002

(86) PCT No.: PCT/IB02/04545

§ 371 (c)(1),
(2), (4) Date: May 18, 2004

(87) PCT Pub. No.: WO03/044826

PCT Pub. Date: May 30, 2003

(65) Prior Publication Data

US 2005/0017643 A1 Jan. 27, 2005

(30) Foreign Application Priority Data

Nov. 22, 2001 (EP) ..... 01204453

(51) Int. Cl.
*H01J 61/54* (2006.01)

(52) U.S. Cl. ..... 313/623; 313/624; 313/625

(58) Field of Classification Search ..... 313/623–625
See application file for complete search history.

(56) References Cited

U.S. PATENT DOCUMENTS 5,905,338 A * 5/1999 Verspaget et al. ..... 313/623
6,294,870 B1 * 9/2001 Kawashima et al. ..... 313/623

FOREIGN PATENT DOCUMENTS

WO WO 0077826 12/2000

* cited by examiner

*Primary Examiner*—Nimeshkumar D. Patel
*Assistant Examiner*—Anthony Perry

(57) ABSTRACT

The invention relates to a high-pressure discharge lamp (1) provided with a discharge vessel (2) made of quartz glass which encloses a discharge space (3) having an ionizable filling and an electrode (4). The discharge vessel (2) is provided with a seal (5) which preferably encloses an Mo foil and forms a feedthrough for an electric conductor (6) to the electrode (4). At the location of the foil, the seal (5) has a gastight sealed cavity (10). According to the invention the cavity (10) is free of a capacitive coupling. This improves reliable ignition.

5 Claims, 3 Drawing Sheets

HIGH-PRESSURE DISCHARGE LAMP

Figure 1:
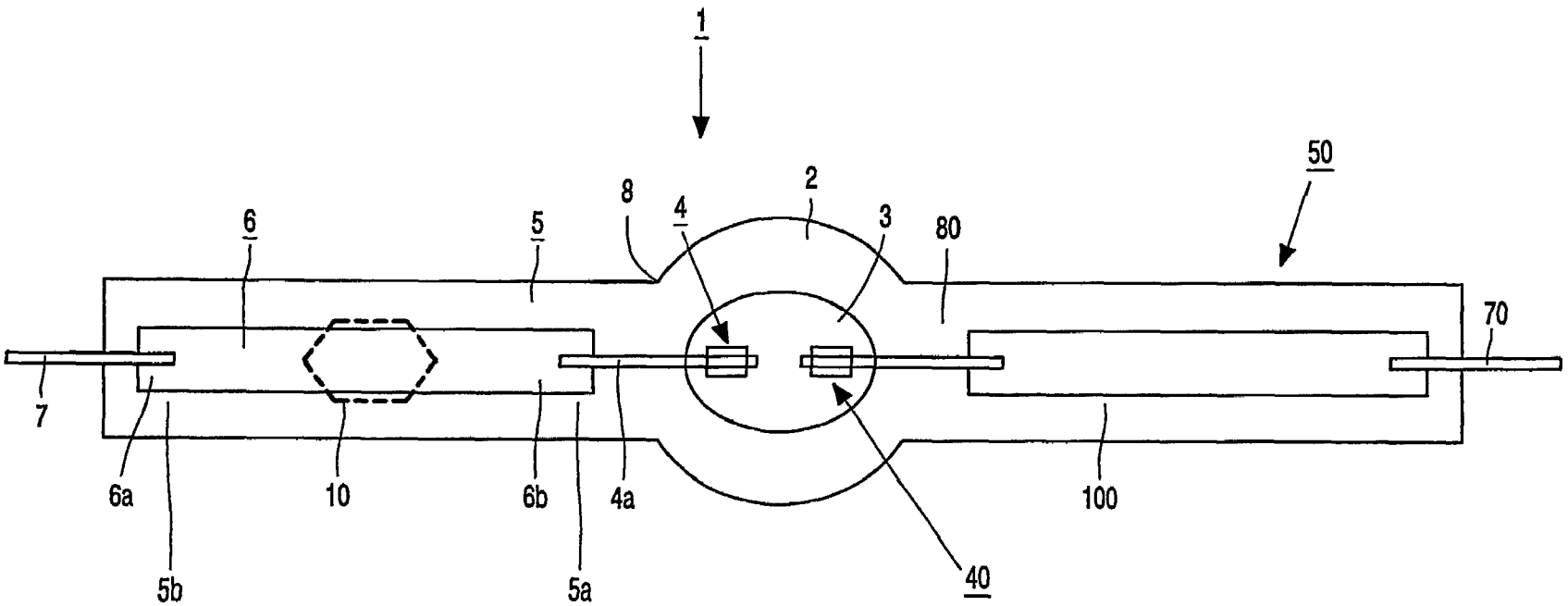

The invention relates to a high-pressure discharge lamp having a quartz glass discharge vessel which encloses a discharge space with a filling comprising at least a rare gas and an ionizable metal for sustaining a discharge during lamp operation, in which a first electrode and a second electrode are present between which the discharge extends during lamp operation, and having a first seal incorporating an electric conductor which connects the first electrode to a metal wire projecting from the first seal to the exterior, said first seal having a first and a second gastight portion between which a gas-filled cavity is present.

A lamp of the type described is known from WO 00/77826. The known lamp is suitable for operation in an optical system, for instance in a projector. The ionizable metal in the discharge vessel is formed by Hg. A further suitable metal is for instance Zn. In this description and the claims, quartz glass is understood to mean a glass having an $SiO_2$ content of at least 95%.

The known high-pressure discharge lamp is provided with a gas filled cavity in the seal and surrounded by an antenna defining a capacitive coupling conductor for a capacitive coupling to the cavity as to promote reliable ignition with use of ignition voltage pulses of a reduced size, e.g. 3 kV. The capacitive coupling counteracts ignition delay when igniting the lamp. The risk of an ignition delay strongly increases when the lamp has been in the dark for some time. The occurrence of ignition delay is a great drawback and, under circumstances, may lead to dangerous situations, for example, when using a high-pressure lamp as a motor vehicle headlamp.

In an alternative lamp having a nominal wattage of at most 100 W the seal of the lamp if free of any cavity, which makes a significant size reduction possible. Thought this lamp needs a high ignition pulse, e.g. 20 kV, for ignition from the cold condition it shows a remarkable good performance in circumstances of hot restrike. After lamp extinction hot restrike takes place within 30 seconds. With increasing lamp power the required pulse voltage for reliable cold ignition increases, leading to extremely high voltage values. This is a serious drawback from a safety point of view.

It is an object of the invention to provide a measure for obtaining a lamp as described in the opening paragraph, in which the drawbacks described above are obviated.

According to the invention, a high-pressure discharge lamp of the type described in the opening paragraph is characterized in that the cavity is free of a capacitive coupling conductor.

Surprisingly the lamp according to the invention has the advantage that, without detracting from the stability of the first seal obtained, the available cavity constitutes a start-promoting means as a source of UV radiation when applying an electric voltage to the lamp. The UV radiation source is referred to as UV enhancer.

Although no capacitive coupling conductor is provided, it has appeared to the inventors that an ignition pulse applied to the lamp electrode suffices to generate UV emission by the UV enhancer. The UV enhancer thus promotes reliable ignition of the lamp even from a dark circumstance and for a lamp with a high nominal power. The absence of a capacitive coupling conductor, in particular the absence of an external antenna has the advantage that ignition pulse height and pulse width are not hampered by risk of dielectric breakdown between antenna and supply leads towards the lamp electrodes. This is of increasing importance with increasing lamp wattage as well as with the continuous strives for further miniaturization of the lamp. Consequently the lamp according to the invention shows a very good hot restrike performance. For reasons of effectiveness the UV enhancer is preferably placed as closely as possible to the discharge vessel. However, for optimum beam properties of an optical system, minimal dimensions of the light source are desired, which is realized by choosing the distance between the first and the second electrode as small as possible. A practical result is that high to very high operating pressures occur in the discharge vessels of such lamps. Consequently, this imposes very strict requirements on the gastight seals of the discharge vessel. Positioning the UV enhancer at a larger distance from the discharge vessel, namely behind the first gastight portion surprisingly does not appear to detract noticeably from the ignition-promoting effect of the UV enhancer.

In an advantageous embodiment of the lamp according to the invention, the electric conductor is a foil, which extends across a length of the first gastight portion, the cavity and the second gastight portion. This forms a considerable simplification of the seal construction and its manufacture. Furthermore the knife edges of the foil will promote the occurrence of electric field concentrations, which on their turn are of advantage for the generation of the UV radiation in the cavity.

The first seal in the lamp according to the invention is preferably a collapsed seal. This has the advantage that the glass has adhered to the electric conductor by means of flowing at the area of the first seal so that the gastight seal is free from internal stress to a considerable extent.

Though the cavity may already function as a UV enhancer containing one or a combination of rare gases, it has turned out that for a reliable lamp ignition procedure the cavity preferably contains mercury vapor. This has the advantage that relatively much UV radiation is generated by the UV enhancer, which contributes to a rapid and reliable ignition. A further advantage of the lamp according to the invention is that no separate mercury dosage appears to be necessary in the circumstance that the filling of the discharge vessel contains Hg as an ionizable metal. This is easily realizable by making the first seal after the discharge vessel has been provided with its filling. For the purpose of electrical connection of the second electrode, the lamp is provided with a second seal for feedthrough of an electric conductor to the second electrode. In an alternative embodiment of the lamp according to the invention, the second seal has the same construction as the first seal, which promotes an efficient production of the lamp.

These and other aspects of the invention are apparent from and will be elucidated with reference to the embodiments described hereinafter.

Figure 2A:
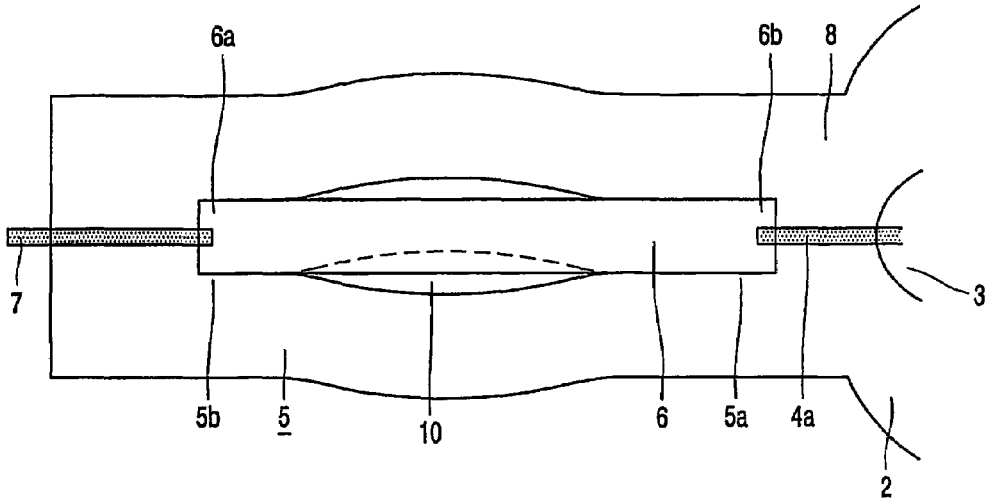
Figure 2B:
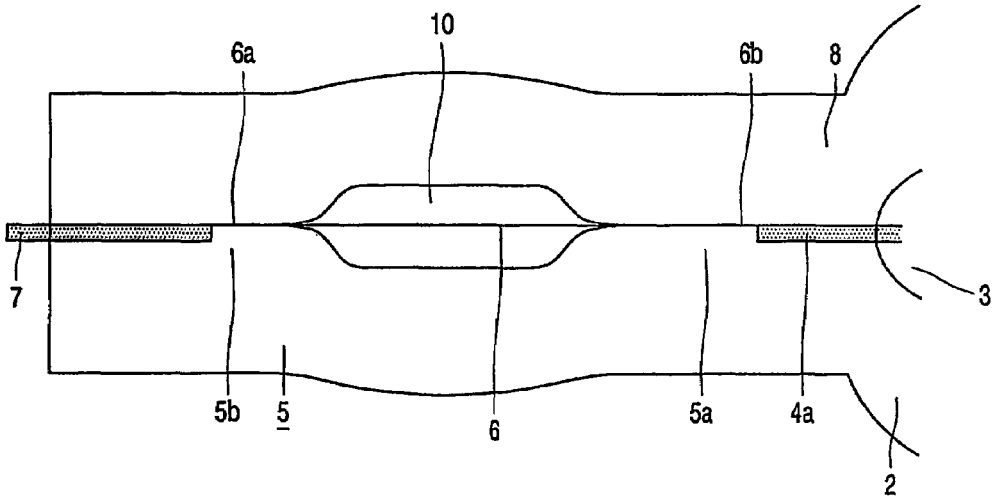
Figure 3:
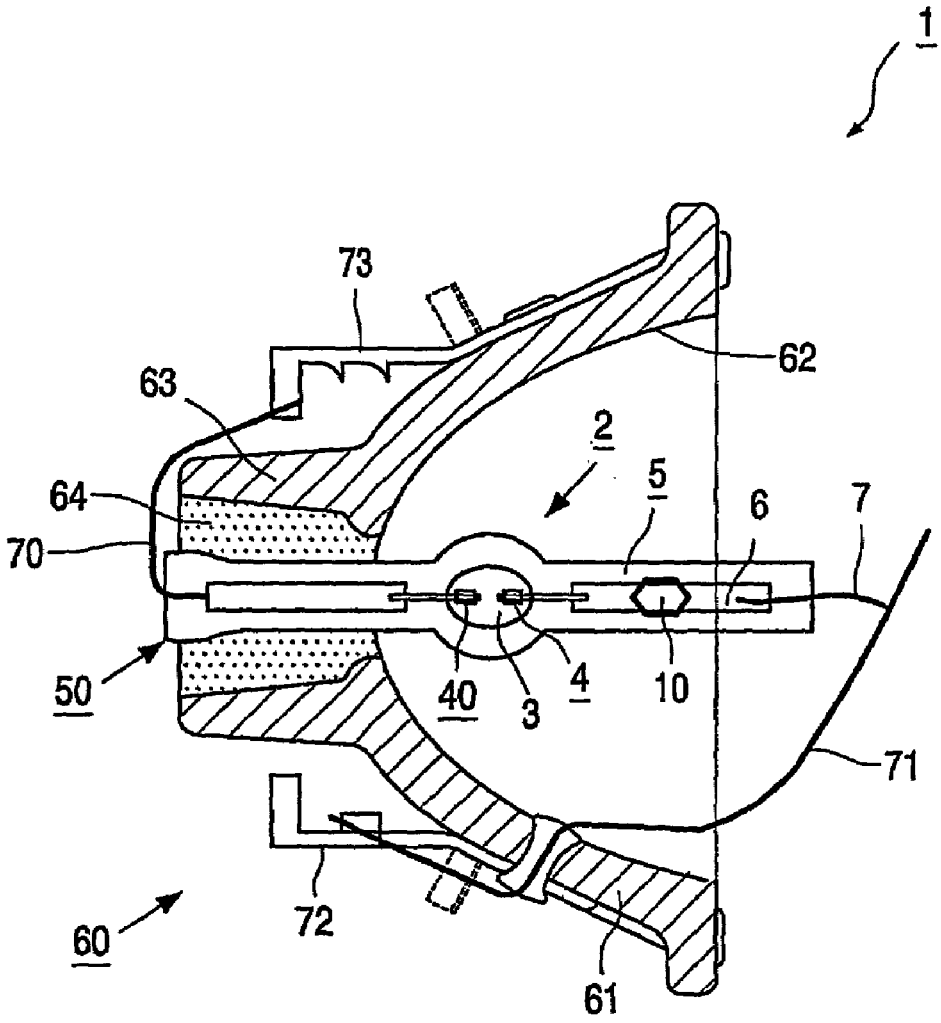

In the drawings:

FIG. 1 shows a lamp according to the invention, comprising a collapsed seal, FIG. 2 shows the collapsed seal of FIG. 1 in detail, and FIG. 3 shows a further embodiment of the lamp according to the invention comprising a reflector body.

FIG. 1 (not to scale) shows a high-pressure discharge lamp 1 provided with a glass discharge vessel 2 which encloses a discharge space 3 with an ionizable filling, in which a first electrode 4 and a second electrode 40 are present, between which a discharge extends during lamp operation, and having a first seal 5 incorporating an electric conductor 6 in the form of a foil which connects the first electrode 4 to a metal wire 7 projecting to the exterior from the first seal, which first seal has a first gastight portion 5*a* and a second gastight portion 5*b* between which a gas-filled cavity 10 is present. The cavity comprises at least a gaseous constituent of the ionizable filling. Preferably, the cavity comprises mercury vapor. The first seal is connected to the discharge vessel at the area of a neck 8.

The first seal 5 constitutes a collapsed seal. The foil 6 is an Mo strip having knife edges. The metal wire 7 is secured to one end 6*a* of the strip, for example, by welding and projects to the exterior from the seal and from the discharge vessel. An electrode rod 4*a* of the first electrode 4 is secured to a further end 6*b* of the strip 6. On the side facing the first electrode 4, the discharge vessel of the second electrode 40 and a second seal 50, with a Mo foil 100 and a neck 80, has a comparable construction. The second electrode is connected to a wire 70. In the operating condition of the lamp, a discharge extends between the electrodes.

FIG. 2 (not to scale) shows the first collapsed seal of the lamp of FIG. 1 in detail, in which FIG. 2A shows the first seal with strip 6 in a plan view and FIG. 2B shows it with strip 6 in a side elevation.

In a further embodiment of the lamp according to the invention, shown in FIG. 3, the lamp comprises a reflector body 60. The reflector body has a glass shell 61 having a shaped inner surface with a mirror coating 62. In the shown embodiment the shaped surface is parabolic. Other shapes are possible for instance elliptical or some complex shape. The reflector body is provided with a neck shaped perturbation 63 through which the second seal 50 of the discharge tube 2 pertains. The second seal is fastened into the neck shaped perturbation by a kit 64. Lamp wires 7, 70 are connected to electrical lamp connection points 72,73, which are mounted on the outside of the reflector body. In the case of wire 7 the connecting is formed by a conductor lead 71 having a leadthrough with the reflector body.

In a practical realization of the lamp in accordance with the embodiment shown, it is a high-pressure mercury discharge lamp having a nominal power of 250 W. The lamp is intended for projection purposes and has a discharge vessel with an internal diameter of 5 mm and an electrode distance of 1.4 mm. The discharge vessel has an ionizable filling which, in addition to mercury as an ionizable metal and a rare gas, for example, argon having a filing pressure of 100 mbar, also comprises bromine. During operation of the lamp, a pressure of 160 bar or more prevails in the discharge vessel. The discharge vessel is made of quartz glass having a largest thickness of 3.5 mm. The knife-edged strip is a Mo strip to which a metal wire is secured at one end. A W electrode rod of a first electrode is secured to the other end of the strip. The lamp is provided on each side with a collapsed seal having a length of 19 mm. A length of 2 mm of the collapsed seal is already adequate for hermetically sealing the discharge vessel. The remaining length of the collapsed seal is used to give the temperature of the electric conductor a sufficiently low value at the area where it is exposed to air. One of both collapsed seals has a cavity. This one collapsed seal has a length of about 5 mm for the first portion between the discharge space and the relevant cavity. The cavity has a length of about 4 mm. The seals have a greatest external diameter of 6 mm. The greatest outside diameter of the discharge vessel is 11 mm and the overall length is 56 mm.

The lamp manufacture starts from a quartz glass tube in which a vessel is formed which is provided with tubular parts at two diametrically opposed locations, which tubular parts will serve for the manufacture of seals. As a first step of the lamp making process, a seal is made on the lamp vessel, for example a collapsed seal after a knife-edged strip and a conductor and electrode secured thereto in known manner have been provided, which collapsed seal is realized by heating the relevant tubular part in such a way that it softens and flows out under the influence of a prevailing sub-atmospheric pressure. This is preferably done by means of a laser beam rotating with respect to the tubular part, which rotating beam is moved from the conductor towards the electrode rod. Subsequently, the discharge vessel is provided with the constituents required for the filling, whereafter a knife-edged strip with secured electrode and ditto conductor is provided at the area of the other tubular part. Subsequently, a collapsed seal is made in a corresponding manner also in the other tubular part by heating and consequent flowing of the tubular part. By interrupting the laser beam at the location of the strip for some time, a gastight cavity is realized. The cavity thus formed comprises a gas, which is present in the tubular part and the discharge space during manufacture of the collapsed seal. The cavity thus formed is thus also automatically filled with vapor of the filling present in the discharge vessel, particularly mercury vapor. This is a great advantage for a satisfactory start-enhancing operation. It has been found that the collapsed seal thus formed, which forms the first seal of the invented lamp, qualitatively constitutes an equally good seal as in the case where the collapsed seal does not have a gastight cavity. For reasons of manufacture efficiency, it is possible to interrupt the laser beam during each seal making, resulting in an alternative embodiment of the lamp according to the invention, wherein the second seal has the same construction as the first seal. In a further alternative the cavity of the first seal is dosed with a dedicated gas mixture, which may be different from the filling in the discharge vessel. Preferably this is done during the seal made as the first step of the lamp making process.

A practical lamp of the type described above with a nominal power of 200 W requires an ignition pulse with a voltage of at most 7 kV and a pulse width of about 180 ns for cold ignition. In a series of test lamps were ignited from a cold and dark condition when connected to a power supply circuit arrangement for supplying 800V, 150 kHz on which a symmetrical ignition pulse of ±7.4 kV (total pulse height 14.8 kV) is superposed having a width of 182 ns. All lamps thus tested did ignite of which 86% at the first ignition pulse. For the same lamp it proved possible to apply on hot restrike an ignition pulse of 20 kV or more and thus realize a hot restrike delay time of between 15 and 30 secondes.

In the case of a comparable lamp without a cavity in one of the seals, a comparable test shows an ignition failure rate of over 20% of not igniting at all and another 20% of ignition only after repeatedly applying ignition pulses.

A comparable test for lamps having a construction according to the prior art, thus including an external antenna around the first seal at the side of the cavity extending along the length of the discharge vessel, only a 75% immediate ignition rate was reached and a failure rate of 25% for not igniting at all. In these lamps the symmetrical ignition pulse is limited in height to +8 kV because of danger of flash over or break down between the antenna and supply leads. This results in hot restrike delay times of more than 1 minute. Such a long delay time is unacceptable in projection systems like a beamer, a projection television system or in a motorcar head lamp system.

The invention claimed is:

1. A high-pressure discharge lamp having a quartz glass discharge vessel which encloses a discharge space with a filling comprising at least a rare gas and Hg, in which a first electrode and a second electrode are present between which a discharge extends during lamp operation, and having a first seal incorporating a first electric conductor which connects the first electrode to a first metal wire projecting from the first seal to the exterior, and having a second seal incorporating a second electric conductor which connects the second electrode to a second metal wire projecting from the second seal to the exterior, said lamp having only one gas-filled cavity, said gas-filled cavity being present in the first seal, and the first electric conductor is a foil, which extends through a length of a first gastight portion, the gas-filled cavity and a second gastight portion, characterized in that the gas-filled cavity is free of capacitive coupling.

2. A lamp as claimed in claim 1, characterized in that the first seal is a collapsed seal.

3. A lamp as claimed in claim 1, characterized in that the gaseous constituent of the filling in the gas-filled cavity comprises mercury vapor.

4. A lamp as claimed in claim 1, characterized in that the lamp has a nominal power of at least 150 W.

5. A high-pressure discharge lamp having a quartz glass discharge vessel which encloses a discharge space with a filling comprising at least a rare gas and Hg, in which a first electrode and a second electrode are present between which a discharge extends during lamp operation, and having a first seal incorporating a first electric conductor which connects the first electrode to a first metal wire projecting from the first seal to the exterior, and having a second seal incorporating a second electric conductor which connects the second electrode to a second metal wire projecting from the second seal to the exterior, said lamp having two cavities, a first cavity present in the first seal, and a second cavity present in the second seal, and the first electric conductor is a foil which extends through a length of the first cavity, characterized in that the first and second cavities are free of capacitive coupling.

* * * * *